US008992060B2

(12) United States Patent
Dassanayake et al.

(10) Patent No.: US 8,992,060 B2
(45) Date of Patent: Mar. 31, 2015

(54) UNIFORM ILLUMINATION OF LAMPS

(71) Applicant: Ford Global Technologies, LLC, Dearborn, MI (US)

(72) Inventors: Mahendra Somasara Dassanayake, Bloomfield Hills, MI (US); Arun Kumar, Farmington Hills, MI (US); Martin Witte, Warren, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 140 days.

(21) Appl. No.: 13/889,526

(22) Filed: May 8, 2013

(65) Prior Publication Data

US 2014/0334173 A1 Nov. 13, 2014

(51) Int. Cl.

| | |
|---|---|
| ***F21V 7/00*** | (2006.01) |
| ***F21V 13/04*** | (2006.01) |
| ***F21S 8/10*** | (2006.01) |

(52) U.S. Cl.

CPC *F21V 13/04* (2013.01); *F21S 48/00* (2013.01)
USPC ..... 362/518; 362/517; 362/540; 362/541

(58) Field of Classification Search

CPC F21V 7/0025; F21S 48/2287; F21S 48/1159; F21S 48/1163; B60Q 1/2696
USPC ..... 362/517, 518, 540, 541
See application file for complete search history.

(56) References Cited

U.S. PATENT DOCUMENTS

| | | | | |
|---|---|---|---|---|
| 4,740,871 | A * | 4/1988 | Dilouya | 362/518 |
| 7,972,046 | B2 * | 7/2011 | Iwasaki | 362/517 |
| 2002/0114166 | A1 | 8/2002 | Muller et al. | |
| 2005/0219857 | A1 * | 10/2005 | Klett et al. | 362/518 |
| 2006/0087860 | A1 | 4/2006 | Ishida | |

FOREIGN PATENT DOCUMENTS

| | | | |
|---|---|---|---|
| DE | 10359182 | A1 | 7/2005 |
| FR | 2831647 | A1 | 5/2003 |

OTHER PUBLICATIONS

3M™ Uniform Lighting Lens (ULL), Technical Data Sheet for the Growth Market Vehicle.

* cited by examiner

*Primary Examiner* — Ali Alavi
(74) *Attorney, Agent, or Firm* — Brooks Kushman P.C.

(57) ABSTRACT

One embodiment of a vehicle lamp assembly may include a housing, which includes a pair of opposing reflective surfaces defining a chamber therebetween. The assembly may further have a single light emitting diode (LED) disposed within the chamber and a lens carried by the housing. At least one of the reflective surfaces may have a grain pattern configured to interact the light emitted from the single LED with the housing in a range between one and five times before the housing directs the light through the lens.

20 Claims, 3 Drawing Sheets

UNIFORM ILLUMINATION OF LAMPS

BACKGROUND

Vehicle manufacturers have been investigating the implementation of light emitting diodes (LEDs) in lamp assemblies in view of the multiple benefits associated with LEDs. For instance, LEDs may require substantially less power than incandescent bulbs, so as to decrease strain on a vehicle battery and increase available electricity for other vehicle systems. Examples of these systems may include DVD players, sound systems and other demanding systems. In addition, LEDs do not have filaments and may therefore be more durable than the counterpart incandescent bulbs. LEDs may also have a lifespan of up to a typical life of a vehicle, which may be significantly longer than that of incandescent bulbs. Moreover, LEDs may generate less heat than incandescent bulbs, thus increasing the longevity of nearby electronic components and plastic components. Furthermore, LEDs may have a greater range than that of incandescent bulbs by, for example, an order of two or three.

It would therefore be desirable to provide a vehicle lamp assembly producing uniform illumination, requiring less maintenance and consuming less energy.

SUMMARY

One embodiment of a vehicle lamp assembly may include a housing, which includes a pair of opposing reflective surfaces defining a chamber therebetween. The assembly may further have a single light emitting diode (LED) disposed within the chamber and a lens carried by the housing. One or more of the reflective surfaces may have a grain pattern configured to interact the light emitted from the single LED with the housing in a range between one and five times before the housing directs the light through the lens.

Another embodiment of a vehicle lamp assembly may have a housing, which includes a pair of reflective surfaces defining a chamber therebetween. The assembly may also have a single LED disposed within the chamber and a lens carried by the housing. In addition, the assembly may have an opaque member, which may be disposed within the chamber and block light directed from the single LED to at least a portion of the lens that is adjacent to the single LED. At least one of the reflective surfaces may have a grain pattern configured to interact light with the housing in a range between one and five times before the housing directs the light through the lens.

Still another embodiment of a vehicle lamp assembly may include a housing, which has a pair of opposing reflective surfaces defining a chamber therebetween. The assembly may further include a single LED disposed within the chamber and a lens carried by the housing. At least one of the reflective surfaces may have a grain pattern configured to interact the light emitted from the single LED with the housing in a range between one and five times before the housing directs the light through the lens. The single LED may have a predetermined angle of throw that directs light toward the reflective surfaces to facilitate the light in interacting with the housing in the range between one and five times before the housing directs the light through the lens.

DETAILED DESCRIPTION

Figure 1:
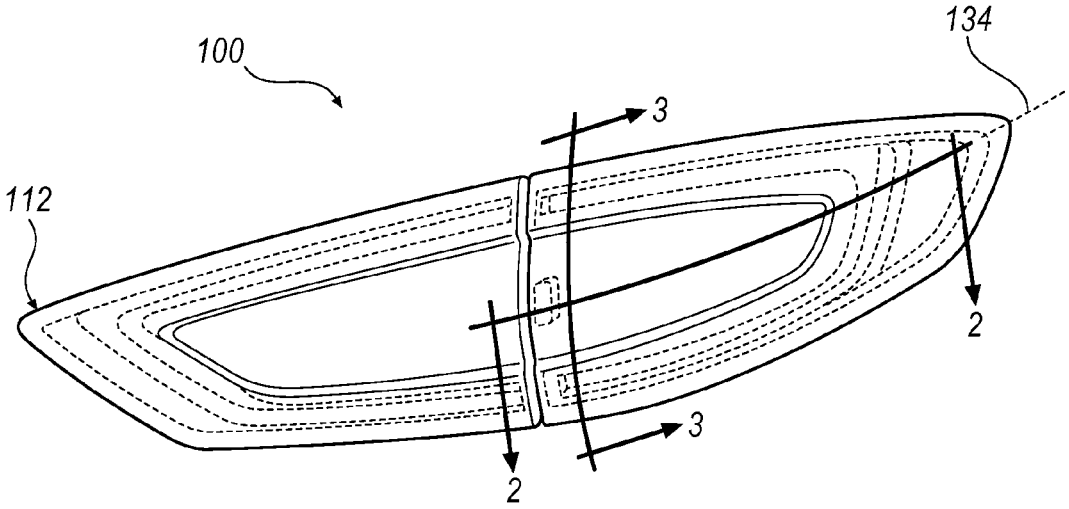
FIG. 1 illustrates a perspective view of one embodiment of a vehicle lamp assembly.

Referring now to the discussion that follows and also to the drawings, illustrative approaches are shown in detail. Although the drawings represent some possible approaches, the drawings are not necessarily to scale and certain features may be exaggerated, removed, or partially sectioned to better illustrate and explain the present disclosure. Further, the descriptions set forth herein are not intended to be exhaustive or otherwise limit or restrict the claims to the precise forms and configurations shown in the drawings and disclosed in the following detailed description.

An exemplary a vehicle lamp assembly may include a housing and a single light emitting diode (LED) disposed within a chamber defined between two opposing reflective surfaces of the housing. One or more of the reflective surfaces may have a grain pattern configured to redirect or interact the light emitted from the single LED with the housing in a range between one and five times before the housing directs the light through a lens carried by the housing. In this respect, the amount of light or energy lost through interactions with the housing can be reduced, so as to permit illumination of at least a portion of the assembly by only one LED. By way of two examples, five interactions with a housing having 95% reflecting surfaces may lose only 27% of the energy, and five interactions with a housing having 90% reflecting surfaces may lose 40% of the energy. Of course, however, a portion of the light may interact with the housing more than five times before exiting the assembly.

Figure 2:
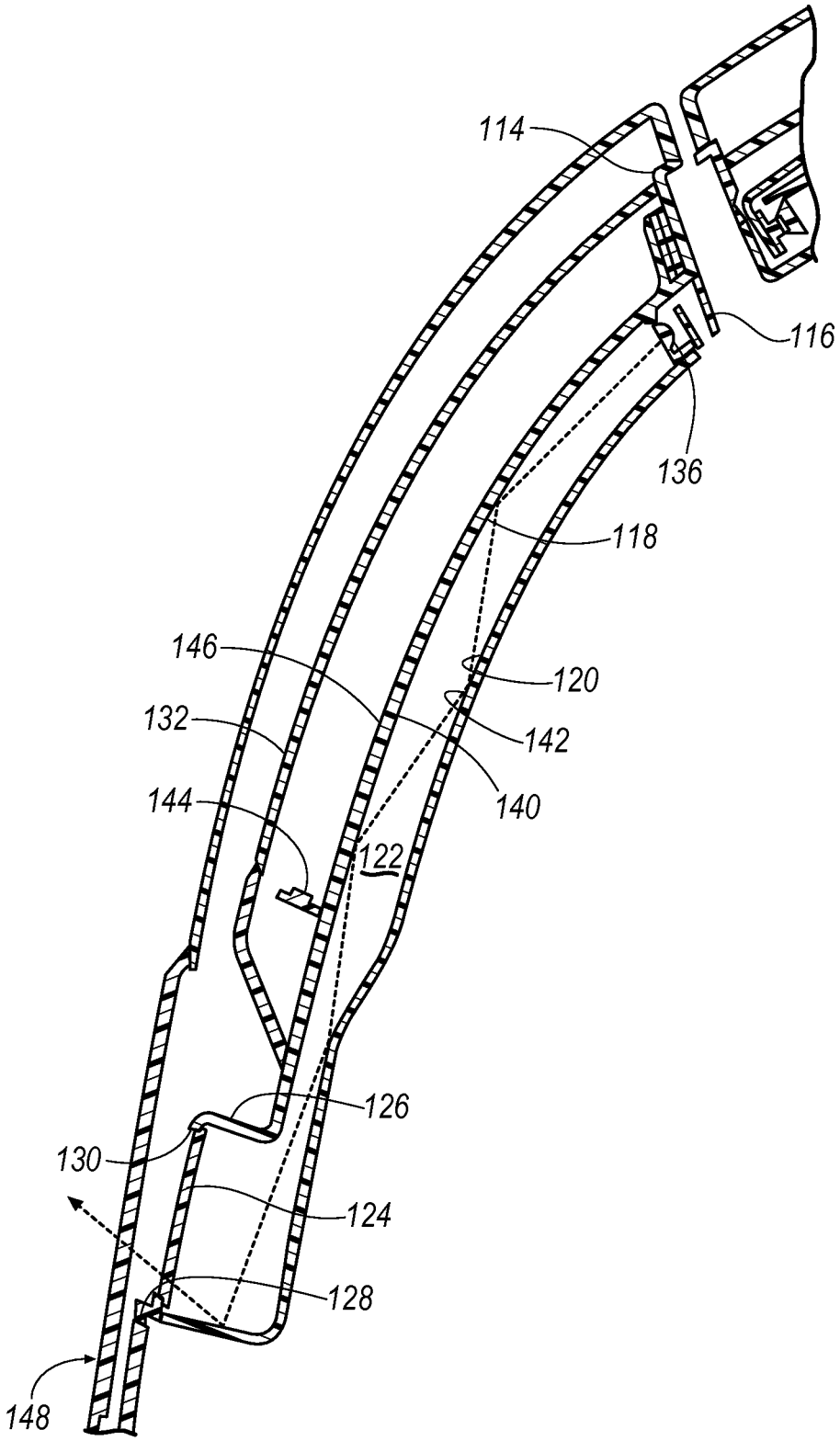
FIG. 2 illustrates a cross-sectional view of the lamp assembly of FIG. 1, as taken along line 2-2.
Figure 3:
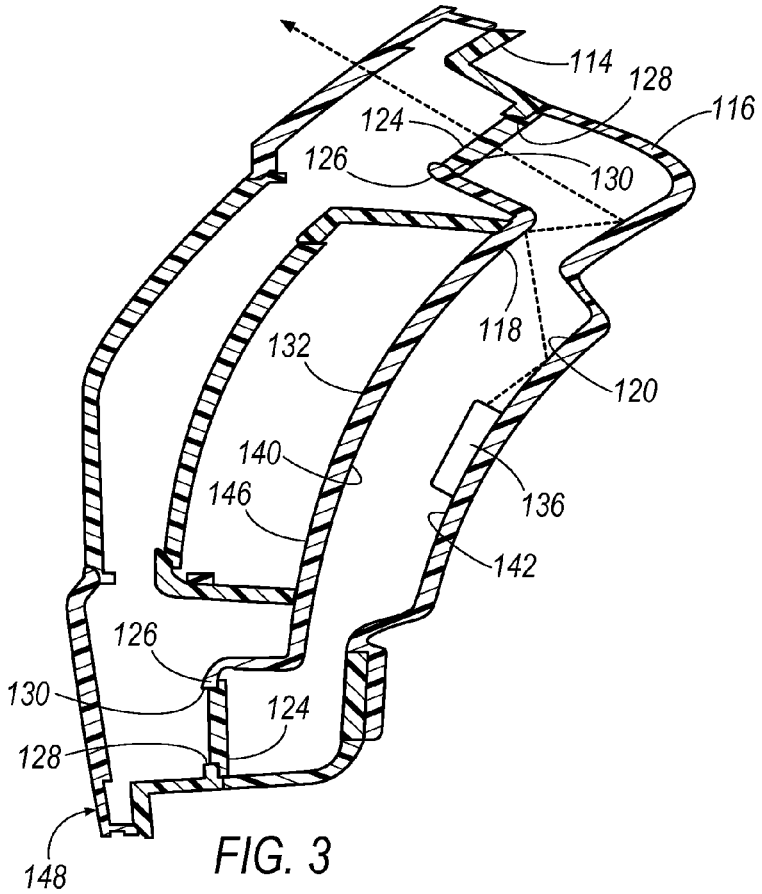
FIG. 3 illustrates a cross-sectional view of the lamp assembly of FIG. 1, as taken along line 3-3.
Figure 4:
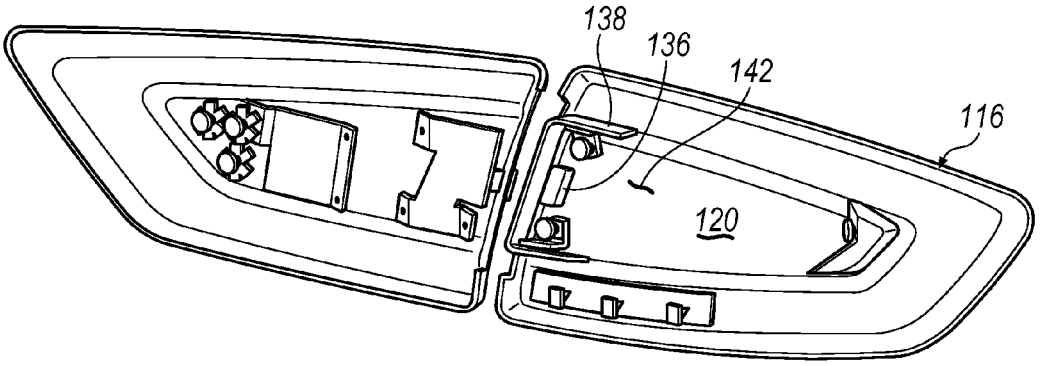
FIG. 4 illustrates a perspective view of a portion of the vehicle lamp assembly of FIG. 1, with a bezel removed from the assembly.

Referring to FIGS. 1 through 4, one embodiment of a vehicle lamp assembly 100 may include a housing 112, which defines a chamber 122 through which light is uniformly scattered. In particular, the housing may include a bezel 114 and a back plate 116 attached to the bezel by screw fasteners, welding, adhesive or any suitable fastener. As best shown in FIGS. 2 and 3, the housing may have a pair of opposing reflective surfaces 118, 120 defining the chamber 122 therebetween. For example, the bezel 114 may have the reflective surface 118, and the back plate may have the reflective surface 120 facing and opposite to the reflective surface 118 of the bezel so as to define the chamber. As one example, the chamber may be somewhat flat and wide to the extent that a mean distance between the reflective surfaces may be less than a square root of the overlapping surface areas of the reflective surfaces. However, the chamber may have other suitable shapes as desired.

The assembly 100 may further include a lens 124 carried by the housing. For example, the bezel 114 may have an outer perimeter 126 with an opening 128, which may extend along the perimeter and include a seat 130 or flange that receives the lens. However, the bezel may have other suitable portions carrying the lens. Furthermore, the bezel may have a central portion 132 disposed radially inward with respect to the perimeter and a central axis 134 extending laterally across the bezel through the central portion.

As best shown in FIG. 2, the assembly 100 may also include a single light emitting diode 136 ("LED") disposed within the chamber and on a central axis 134 extending laterally across the housing. The single LED 136 may have a predetermined angle of throw that directs light toward the reflective surfaces to facilitate the light in interacting with the housing in a range between one and five times before the housing directs the light through the lens. This may reduce the amount of light lost through interactions with the housing so as to permit the use of only one LED to illuminate the assembly. Limiting the number of LEDs to one per chamber may decrease the cost of each assembly, reduce power requirements of the assembly and increase the lifespan of adjacent components. The LED may be disposed within the chamber and spaced apart from the lens, such that the housing blocks a direct external line of sight through the lens to the LED. In this respect, the portions of the assembly, which are illuminated by the LED, may be uniformly illuminated.

The assembly may also have an opaque member 138, such as a ramp, bracket or partition, which may be disposed within the chamber 122 and block light directed from the single LED 136 to at least a portion of the lens that is adjacent to the LED or spaced apart from the LED by a distance that is less than other portions of the lens. In this respect, the portions of the lens that is closest to the LED may be indirectly illuminated by the LED, such that those portions of the housing may not appear brighter than other portions of the housing, which are spaced a greater distance apart from the LED.

The reflective surfaces 118, 120 may be white for diffusely reflecting light throughout the chamber thereby facilitating the single LED with uniformly illuminating the housing. In addition, the reflective surfaces 118, 120 may have a grain pattern 140, 142 configured to interact the light emitted from the single LED with the housing in the range between one and five times before the housing directs the light through the lens. In this respect, the amount light lost during interactions with the housing may be reduced while permitting the light to be sufficiently scattered to uniformly illuminate the housing. In another embodiment, only one of reflective surfaces 118, 120 may have the grain pattern. In addition, the grain pattern may be configured to redirect the light through the chamber such that the light interacts with the housing more or less than five times.

The assembly may further include a supplemental LED 144 carried by an outer side 146 of the bezel opposite to the chamber 122. In addition, the assembly 100 may also have a supplemental lens 124 carried by the bezel to define a supplemental chamber 122, and a cover assembly 148 carried by the bezel. The cover assembly 148 may extend over the chamber, the lens, the supplemental chamber, the supplemental lens, and the bezel.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A vehicle lamp assembly, comprising:

a housing having a pair of opposing reflective surfaces defining a chamber therebetween;

a lens carried by the housing; and a single light emitting diode disposed within the chamber;

wherein at least one of the reflective surfaces has a grain pattern such that the housing interacts with light from the diode in a range between one and five times before the housing directs the light through the lens.

2. The vehicle lamp assembly of claim 1, wherein at least one of the reflective surfaces is white for diffusely reflecting light through the chamber.

3. The vehicle lamp assembly of claim 1, wherein the housing includes a bezel having one of the reflective surfaces including the grain pattern and carrying the lens.

4. The vehicle lamp assembly of claim 3, wherein the housing includes a back plate that has the other of the reflective surfaces and is attached to the bezel.

5. The vehicle lamp assembly of claim 1, wherein the housing blocks a direct external line of sight through the lens to the single light emitting diode.

6. A vehicle lamp assembly, comprising:

a housing having a pair of reflective surfaces defining a chamber therebetween;

a single light emitting diode disposed within the chamber;

a lens carried by the housing; and an opaque member disposed within the chamber and blocking light directed from the single light emitting diode to at least a portion of the lens that is adjacent to the single light emitting diode;

wherein at least one of the reflective surfaces has a grain pattern such that light interacts with the housing in a range between one and five times before the housing directs the light through the lens.

7. The vehicle lamp assembly of claim 6, wherein at least one of the reflective surfaces is white for diffusely reflecting light through the chamber.

8. The vehicle lamp assembly of claim 6, wherein the housing includes a bezel having one of the reflective surfaces including the grain pattern and carrying the lens.

9. The vehicle lamp assembly of claim 8, wherein the housing includes a back plate that has the other of the reflective surfaces and is attached to the bezel.

10. The vehicle lamp assembly of claim 8, wherein the bezel has an outer perimeter carrying the lens.

11. The vehicle lamp assembly of claim 8, wherein the bezel has a central portion disposed radially inward with respect to the perimeter, and the single light emitting diode is disposed on a central axis extending laterally across the housing.

12. The vehicle lamp assembly of claim 6, wherein the housing blocks a direct external line of sight through the lens to the single light emitting diode.

13. A vehicle lamp assembly, comprising:

a housing having a pair of opposing reflective surfaces defining a chamber therebetween;

a lens carried by the housing; and a single light emitting diode disposed within the chamber;

wherein at least one of the reflective surfaces has a grain pattern configured to interact the housing with light from the single light emitting diode in a range between one and five times before the housing directs the light through the lens;

wherein the single light emitting diode has a predetermined angle of throw that directs light toward the reflective surfaces to facilitate the light in interacting with the housing in the range between one and five times before the housing directs the light through the lens.

14. The vehicle lamp assembly of claim 13, wherein at least one of the reflective surfaces is white for diffusely reflecting light through the chamber.

15. The vehicle lamp assembly of claim 13, wherein the housing includes a bezel having one of the reflective surfaces including the grain pattern and carrying the lens.

16. The vehicle lamp assembly of claim 15, wherein the housing includes a back plate that has the other of the reflective surfaces and is attached to the bezel.

17. The vehicle lamp assembly of claim 15, wherein the bezel has an outer perimeter carrying the lens.

18. The vehicle lamp assembly of claim 15, wherein the bezel has a central portion disposed radially inward with respect to the perimeter, and the single light emitting diode is disposed on the central axis extending laterally across the housing.

19. The vehicle lamp assembly of claim 13, wherein the housing blocks a direct external line of sight through the lens to the single light emitting diode.

20. The vehicle lamp assembly of claim 13, further comprising:

a supplemental light emitting diode carried by an outer side of the bezel opposite to the chamber;

a supplemental lens carried by the bezel to define a supplemental chamber; and a cover assembly carried by the bezel and extending over the chamber, the lens, the supplemental chamber, the supplemental lens, and the bezel.

* * * * *